US005986230A

United States Patent [19]

Novak et al.

[11] Patent Number: 5,986,230

[45] Date of Patent: Nov. 16, 1999

[54] METHOD AND APPARATUS FOR SORTING PRODUCT

[75] Inventors: Thomas Joseph Novak, Kingwood; Kaizar Hashim Colombowala, Katy, both of Tex.; Robert Otto Brandt, Jr., Wilmington, N.C.; Roy A. Peets, Albany, Ga.

[73] Assignee: Uncle Ben's, Inc., Houston, Tex.

[21] Appl. No.: 08/853,299

[22] Filed: May 9, 1997

Related U.S. Application Data

[63] Continuation-in-part of application No. 08/713,702, Sep. 13, 1996, Pat. No. 5,865,990.

[51] Int. Cl.[6] ..... B07C 5/00

[52] U.S. Cl. ..... 209/579; 209/580; 209/587; 209/588; 209/639

[58] Field of Search ..... 209/579, 639, 209/580, 581, 587, 588, 644, 922, 908, 924

[56] References Cited

U.S. PATENT DOCUMENTS

| | | | |
|---|---|---|---|
| 1,031,669 | 7/1912 | Twamley . | |
| 3,197,647 | 7/1965 | Fraenkel | 250/225 |
| 3,216,567 | 11/1965 | Kelly et al. | 209/639 X |
| 3,581,888 | 6/1971 | Leonar et al. | 209/639 X |
| 3,871,774 | 3/1975 | Murata | 356/201 |
| 3,956,636 | 5/1976 | Williams | 250/572 |
| 4,161,366 | 7/1979 | Bol et al. | 356/56 |
| 4,196,811 | 4/1980 | Pilesi et al. | 209/588 |
| 4,252,240 | 2/1981 | Satake | 209/580 |
| 4,371,081 | 2/1983 | Satake | 209/580 |
| 4,572,666 | 2/1986 | Satake | 356/239 |
| 4,666,045 | 5/1987 | Gillespie | 209/585 |
| 4,699,273 | 10/1987 | Suggi-Liverani et al. | 209/580 |
| 4,713,781 | 12/1987 | Brizgis | 364/552 |
| 4,752,689 | 6/1988 | Satake | 250/339 |
| 4,806,764 | 2/1989 | Satake | 250/339 |
| 5,245,188 | 9/1993 | Satake et al. | 250/341 |
| 5,448,069 | 9/1995 | Tobler et al. | 250/339.01 |
| 5,524,746 | 6/1996 | Massen et al. | 198/443 |
| 5,659,624 | 8/1997 | Fazzari et al. | 209/580 X |
| 5,669,511 | 9/1997 | Satake et al. | 209/580 |

*Primary Examiner*—David H. Bollinger
*Attorney, Agent, or Firm*—Fulbright & Jaworski L.L.P.

[57] ABSTRACT

The present invention sorts unselected product from selected product using a chute having a grain separating section, a cross section to orientate the product, and a grain stabilizing section; a laser with a laser line transmitted through the product; a photo detector and processor to receive and analyze the light transmitted through the product to determine which product are unselected; and a separator to separate the selected and unselected product.

15 Claims, 10 Drawing Sheets

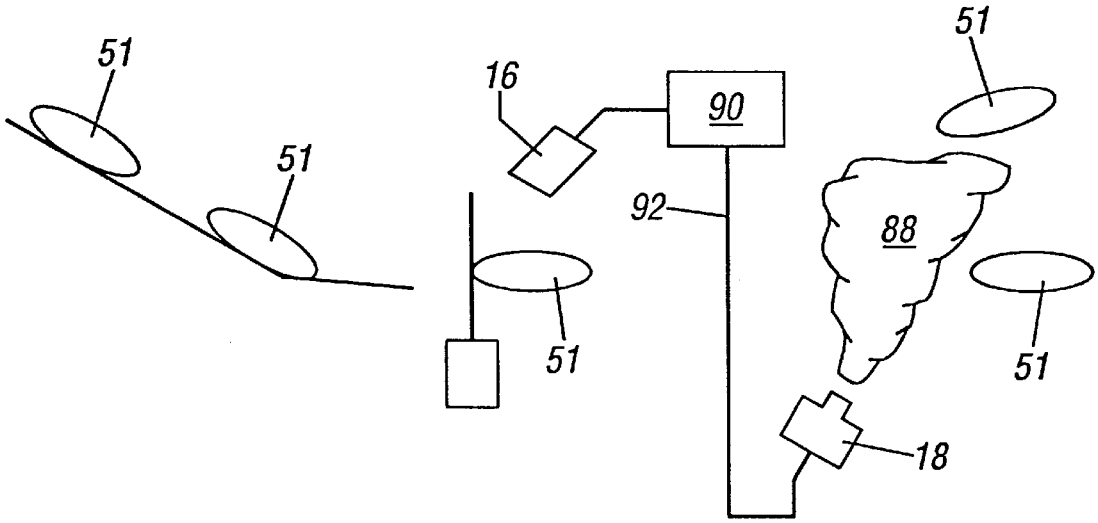
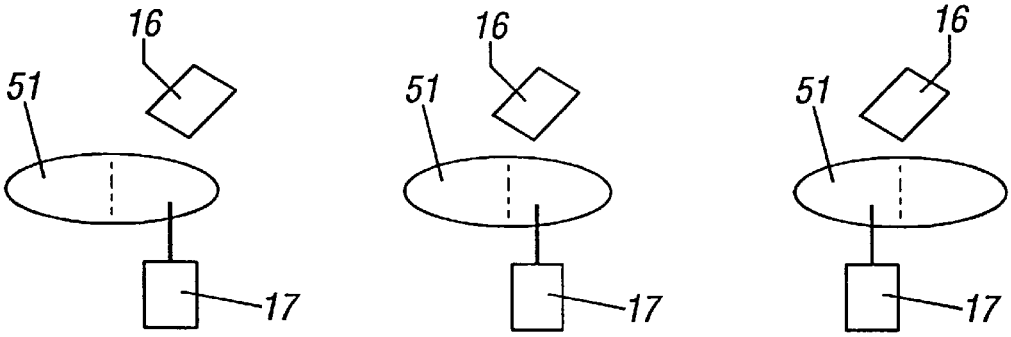
FIG. 8
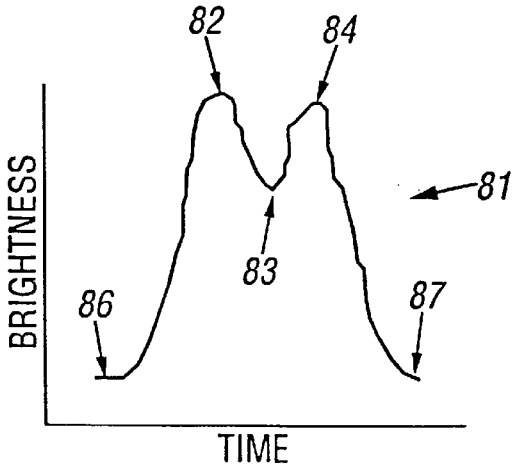

FIG. 16

| ROW | DERIVATION OF ROW | DESCRIPTION OF VALUE OR COMPULATION | VALUE |
|---|---|---|---|
| A | DATA | TOTAL LOT % BROKENS FORMED USING STANDARD USDA TEST MILLING PROCEDURE, MILLED BASIS, WT. % | 23.8% |
| B | A/100 | PARTS OF BROKENS FORMED IF TOTAL LOT IS WHITE MILLED (CONVERTED TO WEIGHT FRACTION OF FEED) | 0.238 |
| C | TYPICAL RESULT | % EJECTED AS WHOLE UNDEFECTIVE KERNELS, AS A WT. PERCENT OF THE FEED | 60.0% |
| D | DATA | % BROKENS IN THE EJECTED FRACTION, AFTER WHITE MILLING | 4.1% |
| E | C x D | PARTS OF BROKENS IN THE EJECTED FRACTION, AS A WEIGHT FRACTION OF THE FEED | 0.024 |
| F | 100% - C | % NOT EJECTED AS A WEIGHT PERCENT OF THE FEED | 40.0% |
| G | TYPICAL RESULT | % BROKENS IN THE NOT EJECTED FRACTION AFTER PARBOILING AND MILLING | 6.9% |
| H | F x G | PARTS OF BROKENS FORMED IN THE NOT EJECTED FRACTION AFTER PARBOILING AND MILLING (AS A WEIGHT FRACTION OF THE FEED) | 0.028 |
| I | E + H | PARTS OF BROKENS FORMED IN BOTH FRACTIONS (WHITE MILLED EJECTED AND PARBOILED/MILLED NOT EJECTED AS A WT. FRACTION OF THE FEED) | 0.052 |
| J | (B - I)/B x 100 | % AVOIDANCE IN TOTAL OVERALL BROKENS FORMALION | 78.1% |
| K | DATA | % PECK IN THE FEEDSTOCK ROUGH RICE | 1.00% |
| L | DATA | % PECK IN THE EJECTED PORTION | 0.12% |

METHOD AND APPARATUS FOR SORTING PRODUCT

This application is a continuation-in-part of application Ser. No. 08/713,702, filed Sep. 13, 1996, now U.S. Pat. No. 5,865,990.

FIELD OF INVENTION

The invention relates to a method and apparatus for separating unselected product from more selected product, including separating desired grain, nuts, and beans from undesired product.

BACKGROUND OF THE INVENTION

Many areas of the food processing industry are concerned with sorting marketable or higher valued product from less desirable product. For example, the rice milling, nut processing and bean processing industries all sort bulk product to weed out lower quality or aesthetically unpleasing product.

In the rice milling industry, for example, whole grain yield is highly valued. A broken grain is worth half or less in the marketplace compared to a whole grain. Also, a small difference in the amount of broken grains level in the milled rice will significantly lower its quality grade. As such, broken grains are removed from milled rice and sold off at a lower price.

The rice 'milling' industry consists of two general types of rice mills: white rice mills and parboiled rice mills. In a white rice mill the rough rice is dehulled and milled, along with numerous mechanical cleaning and defect separation operations. In a parboiled rice mill, the rough rice is steeped in hot water, steamed, dried, dehulled and milled, along with numerous mechanical cleaning and defect removal operations. Parboiling has several advantages for improving the rice's cooking quality and milling yield.

For a white rice miller, brokens in milled rice are in part caused by imperfect grain structure. These are immature grains, chalky grains and internally cracked grains in rough rice. Immature grains are underdeveloped, are generally thin and break easily. Chalky grains have milk-white or opaque centers and are sometimes called white bellies. Chalkiness is caused by the presence of air or due to less dense packing of starch in the endosperm. It is soft and also breaks easily. Cracked kernels are caused by either over drying prior to harvest, uncontrolled moisture adsorption or desorption, mechanical harvest damage, or by some other post harvest damage. Rapid or uncontrolled moisture change causes mechanical stress in the rice kernel. If the stress exceeds the tensile strength of the kernel, a crack or check is the result. For parboiled rice millers, neither chalk nor cracked grains cause breakage as they are almost completely healed during the hydro-thermic processing. Thus, parboiled rice millers have a whole kernel yield advantage over white rice millers. This disadvantage could be eliminated, if the white rice millers could obtain crack and chalk free rice for milling.

In another example of the tree and ground nut processing industry, the value of the nuts are significantly influenced by the presence of foreign material and defective nuts. The foreign material and defects can include but not be limited to unblanched nuts, discolored nuts, mold, immature nuts, nut grass seeds, glass, stones, metal, nut skins, nut shell, stems, and corn.

In the nut industry, nuts are removed from the shell by means of mechanical crackers, blown and separated from the shell material and classified by density size. This process does not efficiently or completely remove undesirable material from the nut meat. Defects and foreign material still remain with the good product and additional efforts must be employed to further reduce the level of the undesirable to an acceptable level. The additional capital equipment and personnel required to produce this highly segregated material result in a high cost to the user. This puts consumer nut product producers at a price disadvantage due to the high processing costs required for the premium quality nuts. To offset a portion to the reprocessing and separation costs, nut processors have employed electronic sorters to reduce the quantity of good product in the waste material stream to improve overall yield. Further, these sorters are used to remove foreign materials to maintain an acceptable quality level. Therefore a producer is faced with balancing the cost of raw material with varied quality attributes and the cost (or yield) of the resulting finished product. A distinct advantage to a producer can be realized if the efficiency and capital cost of the sorting equipment can be technologically optimized.

The following disclosures are related to the sorting process used in the present invention. Massen, et al., U.S. Pat. No. 5,524,746, discloses an apparatus for sorting bulk rice using an optical monitor to detect grains of different color or luminosity or grains of different size or shape that travel on a conveyor belt. When the optical monitor detects an imperfect rice grain, a jet of air from a nozzle removes the grain from the conveyor belt. Satake, et al., U.S. Pat. No. 5,245,188, discloses an apparatus for evaluating the grade of rice grains using grooved chutes in which the individual grains fall through past a light source. Detectors measure both the reflected and transmitted light from each grain and determine if the grain is complete, scratched or discolored. Inferior grains are sucked from the grooved chutes and removed through a different outlet. Satake, U.S. Pat. No. 4,806,764, discloses an apparatus for evaluating the quality of rice grains using an infrared spectrometer with a band-pass filter and detectors for measuring reflected light to measure the content percentages of pre-selected constituents, such as protein, amylose, amylopectin, and moisture. From the various content percentages, quality evaluation values are determined. Satake, U.S. Pat. No. 4,752,689, is related to the previous patent except that it prints or displays the actual percentage contents of constituents. Gillespie, et al., U.S. Pat. No. 4,666,045, discloses a pit detection apparatus and method for fruit sorting using a sweeping transmission scanning beam with sensors and a sizing beam with sensors. Pits are detected from analyzing the amount of light transmitted through the fruit at various points in the fruit. Fruit with pits are then removed by an ejector valve. Satake, U.S. Pat. No. 4,572,666, discloses an apparatus for detecting cracked rice grains in hulled or unhulled grains using a chute or conveyor belt, a light source, and two light detectors. Cracked grains are determined by comparing the amount of light transmitted through leading half part of an inspected grain to its trailing half part. Based on the grain's position, less light will be transmitted through one-half of a cracked grain in comparison to the other half. Pilesi, et al., U.S. Pat. No. 4,196,811, sorts buttons by measuring the amount of light transmitted through each button as it travels down a chute. Murata, U.S. Pat. No. 3,871,774, detects cracks in unhulled grains by irradiating the grain with a laser and measuring the light transmitted through the grain which is conveyed through the laser beam. The amount of light transmitted through the grain decreases when a crack is scanned. The patent does not disclose a method to sort the grains, a laser line, a means to separate grains for detection, a grain stabilizing means, or any features to make the invention commercially efficient. Fraenkel, U.S. Pat. No. 3,197,647, sorts white from red rice by measuring the light transmitted through each grain. Twamley, U.S. Pat. No. 1,031,669, tests the maturity of corn kernels by transmitting light through the kernels. Brizgis, et al., U.S. Pat. No. 4,713,781, analyzes damaged grain by illuminating a grain with long wave, ultraviolet radiation, causing the exposed starch of the damaged section to fluoresce. The amount of fluoresce determines the amount of damage to the grain.

Generally, sorting equipment for product falls into two basic categories: gravity chute type and belt type. In the gravity chute type the product stream is divided and fed into multiple, parallel chutes designed to place the product into a single row of material, sliding down a "v" channel chute. The purpose of this is to present the product in front of a detector, one individual piece at a time. The negative result of this method is that the product is not under any positive control, once it begins its descent down the chute. This results in varying velocities and spacing at the chute discharge. These variables act together to allow the individual product to wobble down the chute and not be perfectly aligned with the detector. This alignment is critical to the capability of the sorter to detect and accurately reject unacceptable material. The light source used to illuminate the product as it falls past the detectors can be incandescent or florescent. The type of defect that can be seen is determined by the wavelength of the light source and/or suitable filtering over the detector.

In the belt type sorter, the product is fed onto a high-speed (approximately 150 m/minute) belt in a manner to distribute the product such that each individual piece is not touching. The product is illuminated and detected at the end of the belt while it is in free fall. Undesirable material is rejected at this point. Illumination can be with florescent or laser light sources. Specific wavelengths are also obtained with the use of filtering and/or specific wavelength sources. The method of illumination with a laser is by use of a laser produced beam of light which is reflected off a multi-faceted rotating mirror, creating a line of light across the belt. Since the line is really a spot of light moving across the belt, it does not completely illuminate the product as it passes by it. This results in a maximum potential accuracy that is directly proportional to the number of times that each individual product is scanned.

In either case, the use of lasers provides a much higher intensity of light to illuminate the nuts making the sensitivity of the detection system less critical. Lasers are coherent light sources. This allows selection of specific wavelengths of light to be used, tuning the unit to specific undesirable materials. It can be seen in the above descriptions that an improvement in accuracy can be realized if the presentation of the product to the detector is made repeatable and the laser is made to scan more frequently or employ use of a continuous line of laser generated light.

With the conventional apparatus or methods disclosed above, it is not possible to sort many products in a commercially efficient manner for use. For commercial purposes, the evaluation of product must be done quickly with minimum error. In the previously disclosed art, an individual product travelling at a high velocity may not be properly stabilized when it is analyzed because air resistance and other factors may oppose the natural product orientation. If the product is wobbling, a structural defect may not be detected. The prior art also does not disclose adequate methods for separating product prior to analysis using a chute. Additionally, the lasers used to analyze objects in the previously disclosed art are typically focused to the smallest spot size possible and do not illuminate some defects that are not precisely positioned. Also, the photo detection systems used do not provide a strong signal for better resolution of the signal. With a commercially efficient sorting invention, product could be separated into two fractions: selected and unselected product. Then, for example, white rice millers could process the internally whole unhulled grains for a higher yield for those who would pay a premium price for the internally whole unhulled grain. The internally defective unhulled grains—which would have resulted in broken rice for the white rice millers—can be used by parboilers for processing.

SUMMARY OF THE INVENTION

The present invention overcomes the limitations of the prior art and discloses an apparatus for sorting unselected product from selected product. The invention includes a chute with a separation section, a cross section for properly orientating the product, and a stabilizing section; a laser line with a continuous laser line transmitted through or reflected from the product after the product has been separated, orientated and stabilized; a photo detector and processor to receive and analyze the light transmitted through or from the product to determine if the product is selected or unselected; and a separating means connected to the processor to separate selected and unselected product.

The present invention also contains a method for sorting unselected product from selected product with the steps comprising aligning the product in the chute; creating distance between individual product in an inclined chute; stabilizing product in the chute with centripetal force for optical detection; optically analyzing the product with a laser line and producing an output; determining from the output of the optical analysis if the product is selected or unselected; and separating the unselected product from the selected product.

The above described inventions can be utilized for sorting shelled blanched or unblanched ground nuts and tree nuts, including split or unsplit whole nuts; for sorting good nuts from defective nuts; and for sorting good nuts from foreign material. The above described invention can be utilized for sorting unhulled grains, including unhulled rice grains; for sorting brown rice; for sorting internally cracked grains from internally whole grains; for sorting discolored grains from properly colored grains; and for sorting chalky grain from non-chalky grain. In addition, the invention can be used for sorting cocoa and other beans. Generally, the invention can be used to sort any product that is typically sorted by chutes. The transmitted light can be detected using a photo detector and the product can be physically separated by removing certain product from the path with a blast of air. The photo detector can also utilize a large aperture and a plurality of lenses.

An object of this invention is to provide a chute to discretely deliver product for improved scanning and removal purposes using a dual curvature chute.

An object of this invention is to provide a laser line for continuous and more complete scanning of product.

BRIEF DESCRIPTION OF THE DRAWINGS

The embodiments will now be described with references made to:

FIG. 8 shows the operation of the detection and separation system.

FIG. 16 shows the results of a test run on rough rice using the method of this invention.

DESCRIPTION OF THE PREFERRED EMBODIMENTS

Figure 1A:
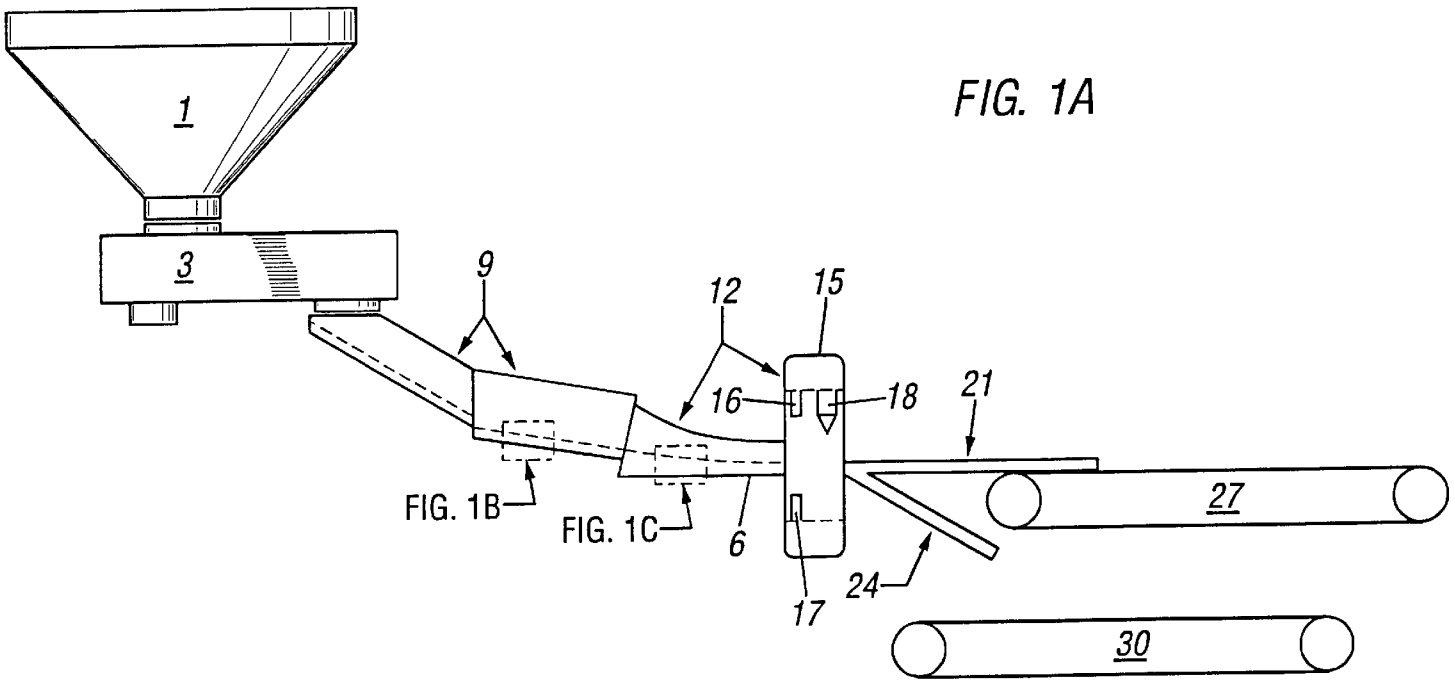
FIG. 1A shows an overview of the claimed invention.
Figure 1C:
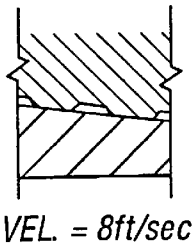
FIGS. 1B and 1C show expanded views of sections from the invention.
Figure 1B:
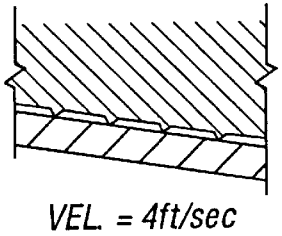

As shown in FIG. 1A, product in a hopper 1 is dispensed into a vibratory feeder 3 where product is carried to singulation channels 9. Individual product will drop from the vibratory feeder 3 into the singulation channels 9 where the product is separated into chutes that are narrow enough to only accommodate one individual piece of product at a time. The product is aligned end to end as shown in FIG. 1B. The apparatus and method for feeding product into single product chutes is well known in the industry.

After the product has been separated into single product chutes, the product moves into the present claimed invention 12. The product initially passes through one of the chutes in a series of parallel chutes 6. In the chutes 6, the individual product is separated from one another (as shown in FIG. 1C), in each chute by a dual angle section of the chutes 6. The grooves properly orientate the product for optical analyses. A curved portion of the chutes 6 stabilizes the product with centripetal force. When the product is properly separated, orientated and stabilized, the product leaves the chute and is optically examined by the detection and separation system 15 which utilizes laser 17 and photo detector 16. The selected product is then removed by a blast of air from nozzle 18. The product may be analyzed on chute 6 or subsequent to the end of chute 6. Preferably, the product is analyzed and removed while airborne path 24 from where the selected product is conveyed away by conveyor 30. The unselected product is not blown off course by nozzle 18 and is transported along path 21 from where it is conveyed away by conveyor 27.

Figure 2:
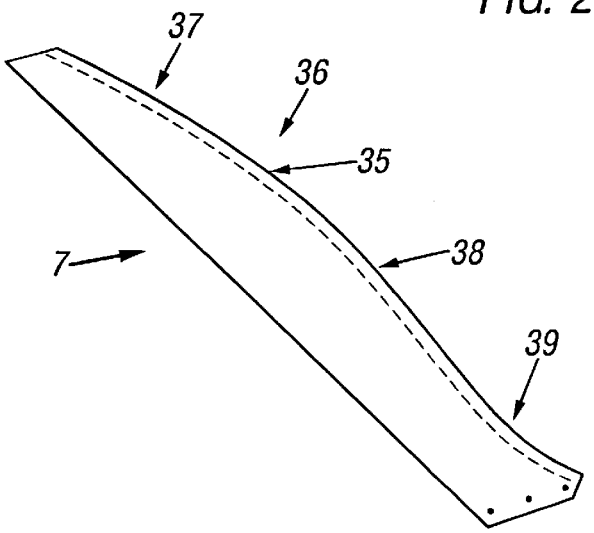
FIG. 2 shows a side profile of the chute.

A profile of a single chute 7 of the parallel series of chutes 6 is shown in FIG. 2. The chute 7 has an upper acceleration section 36 and a lower radial product stabilizing section 39. Acceleration section 36 is positioned at an angle level to the floor between 30 to 60 degrees. The acceleration section 36 contains two angled sections 37 and 38 to separate the product passing along the acceleration section 36. The first angled section turns into a steeper angle with relation to the floor at bend 35. Product falls from the first angled section 37 at bend 35 onto second angled section 38. The product falling onto second angled section 38 uses gravity to accelerate away from the next product piece on chute 7. The product must be properly separated to be analyzed. A preferred embodiment is a separation of about one product length which is approximately equal to a range between 1.5 to 2.5 milliseconds between rice grains passing through the detection and separation system 15. However, one skilled in the art knows that this time will vary depending on the performance limits of the product ejector, the photo detector used, the processor used, the weight of the product, the shape of the product, and other limits or variables. The time or distance between product is set in part by the angles of sections 37 and 38 given a certain friction between the product and chute. The friction depends in part upon the chute coating, the type and shape of product used, and the velocity of the product.

Figure 3:
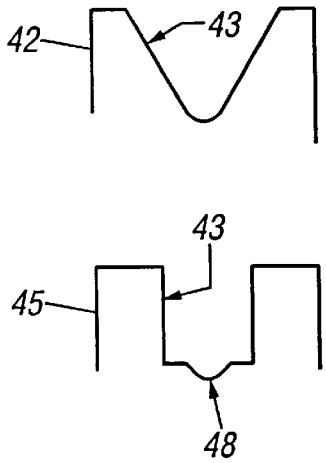
FIG. 3 shows cross sections of the chute.

The stabilizing section 39 of chute 7 solves the problem encountered in optically analyzing fast moving product. Most individual product, placed on a flat level surface, has a natural orientation based on the grain geometry. For example, a rice grain tends to orient itself so that the length of the grain is parallel to the chute path. When sliding down a conventional conveyor at low velocities, the grain keeps it's natural orientation. A conventional conveyor is typically positioned at an angle level to the floor in excess of 45 degrees. The conveyor may have a channel, such as a H, V, or U channel, to guide the grain orientation. At high velocities air resistance, momentum, and other factors oppose the natural product orientation. Cross sections of a channel 42 and an H channel 45 with lower grove 48 is shown in FIG. 3. For example, a rice grain sliding at a high velocity may not remain in the proper orientation. When product loses its natural orientation in the channel, it creates a problem for the optical or electronic sensor. The problem is solved by using a curved conveyor as show in the stabilized section 39 of chute 7 in FIG. 2. To keep any object moving in a circle, a force must be supplied pulling the object inward toward the center. A force pointed radially inward is a centripetal force. The curved conveyor exerts a centripetal contact force on the grain or other product. This force causes the grain or other product to lie flat in its natural orientation without wobbling on the stabilizing section 39 of chute 7 even at high velocities.

Because the product is stabilized by the stabilizing section 39, the product can be launched from the chute 6 before the product is optically analyzed. Prior art requires high velocity product to be analyzed while still in a chute because the product was not stable enough to be launched into mid air before analysis. The prior art typically analyzed product while passing over a window or slot in the chute. However, dirt, dust, and other particles can clog or block the window or slot. When the window or slot is blocked, optical analysis is either hindered or prevented. Launching stable product into mid air for analysis is better for accuracy and preventing maintenance shut downs.

The chute 7 also has a coating 43 to establish a certain friction and to reduce wear on the chute by passing product. A preferred embodiment uses an anodized teflon coating on an aluminum chute. The coating provides a low coefficient of friction to facilitate movement of product along the chute. The coating also protects the chute from wear and tear. Fast moving product is abrasive on any surface it passes over. An aluminum chute would have a short life span due to the abrasive environment unless it was coated with a protecting layer. A chute can be constructed using a harder material, but it is cheaper to fabricate the shape and grooves of the chute with aluminum and then coat it. Other coatings can be used, such as ceramics, that prevent wear and reduce friction.

The chute 7 also uses certain channel shapes to properly orientate the product, as illustrated in FIG. 3. A preferred embodiment of the chute 7 uses a V-shaped channel 42 in the upper portion of the chute 7 and an H shaped channel 45 in the lower portion of chute 7. The V shaped channel 42 is used to orientate the product so that the length of the product runs parallel to the direction of the chute. The H shaped channel 45 is used to orientate the product so that the product's belly is in the channel's groove 48. Especially in the case of grain, this position assures that any crack in the grain will be properly exposed to the laser. However, any channel shape within the scope of the invention may be used.

Figure 4:
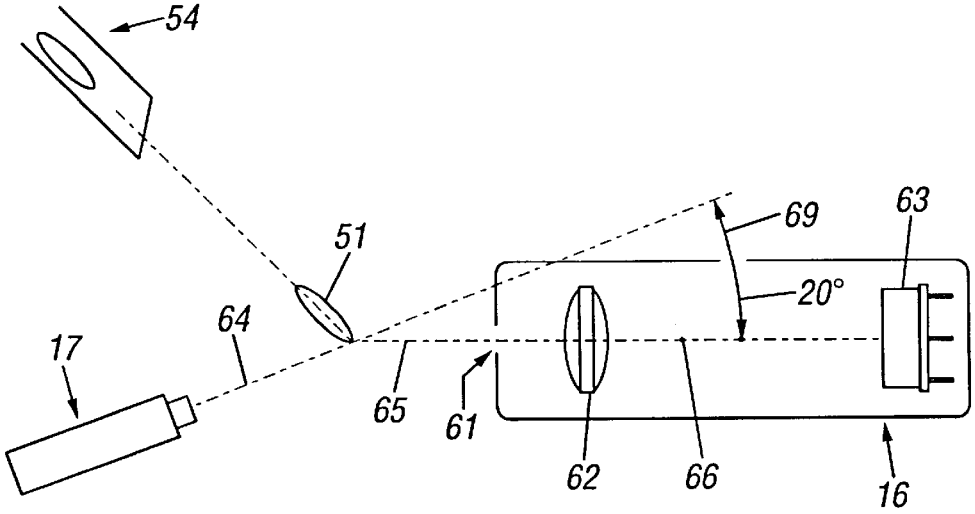
FIG. 4 shows the operation of the optical detection system utilizing a single lens.

After the product is properly separated, orientated and stabilized for analysis, the detection and separation system 15 optically analyzes the product. FIG. 4 shows the process of optical analysis of a grain. In FIG. 4, laser 17 directs a laser beam 64 toward a passing grain 51. The laser light transmits through grain 51 and towards photo detector 16. To prevent the laser from saturating the detector, the photo detector needs to be placed at a certain angle 69 and at a slight offset with respect to the laser beam 64. A preferred embodiment of angle 69 is about 20°, but may vary upon the object being analyzed and the laser being used. The transmitted light 65 enters into photo detector 16 through slit 61 and through a lens 62 with a focal line 66. The width of the slit 61 should be smaller than the width of a defect in the grain being analyzed. The length of the slit 61 should be at least one and one-half to two and one-half rice units wide or about two-tenths of an inch wide. The lens 62 shown in FIG. 4 is a double-convex lens. A photodiode detector 63 is positioned to receive the transmitted light 65 passing through lens 62. The slit 61 limits the detecting view of the photodiode detector 63. Note that any other suitable means for transmitting and detecting light can be used besides the laser and photodiode detector shown.

Figure 5A:
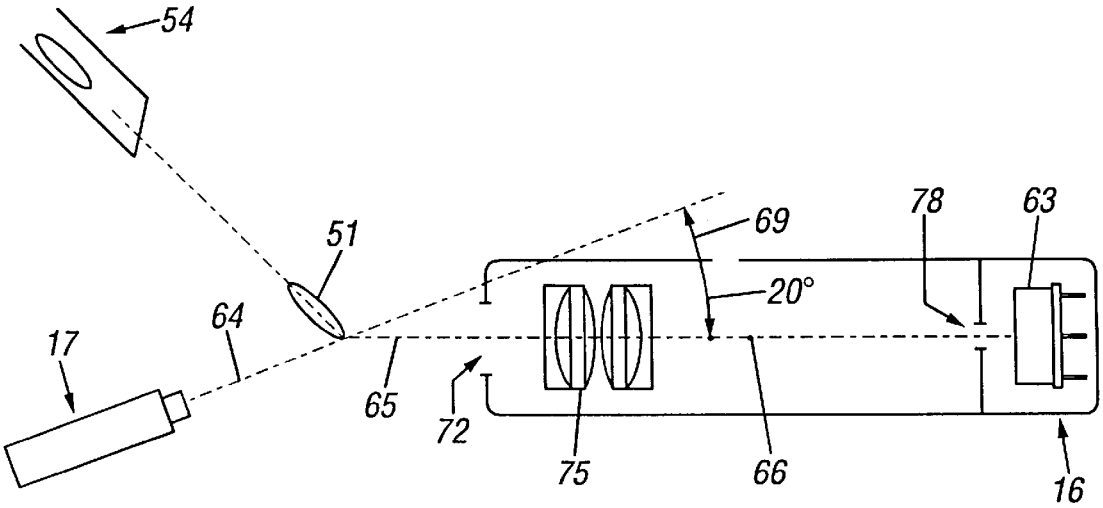
FIG. 5A and 5B show a optical detection system similar to the one in FIG. 4, but with a doublet lens and a larger aperture.
Figure 5B:
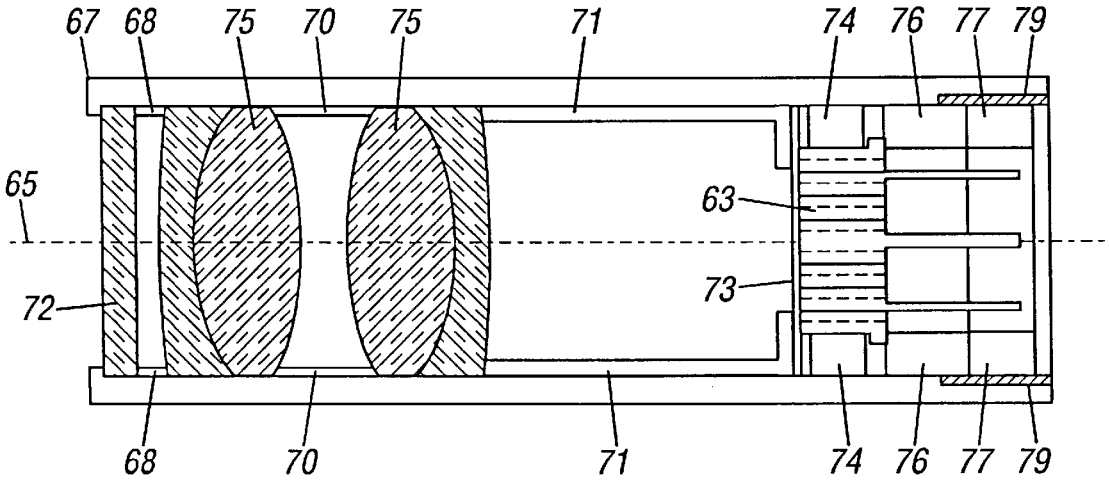

The design of the sensor in FIGS. 5A and 5B improves the signal strength received by processor 90 without having to electronically enhance the signal. The transmitted light 65 passes through a larger aperture 72 which is approximately 12.5 millimeters. The larger aperture allows approximately twenty times more light to reach the photodiode detector 63 which increases the signal strength proportionately. The plurality of lenses 75 better focus the increased amount of light onto the detector 63 through slit 78. Slit 78 limits the detecting view of the detector 63. The slit 78 in FIG. 5A is located between the lenses 75 and the detector 63 while the slit 61 of FIG. 4 is in front of the lens. Spacers 68 hold the window of aperture 72 in place. Spacers 70 hold the plurality of lenses 75 in place. Spacers 71 separate the lenses 75 and the detector 63 while spacers 74 and 76 hold the detector 63 in place. Threading for retainer 79 and retainer 77 also hold detector 63 in place.

Figure 6:
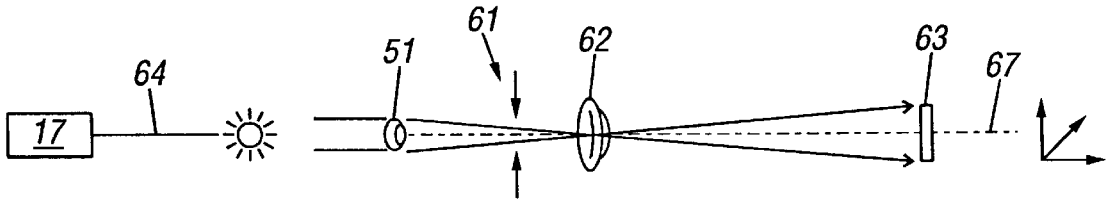
FIG. 6 shows the optics involved with laser beam analysis.
Figure 7:
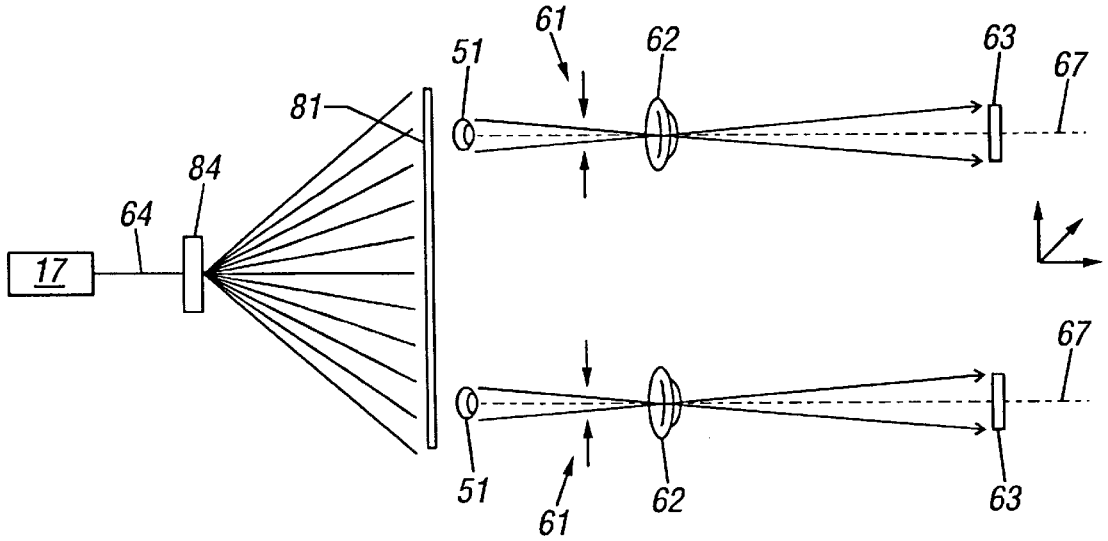
FIG. 7 shows the optics involved with laser line analysis.

The present invention utilizes a laser line 81 instead of a laser beam 64 as shown in FIGS. 6 and 7. The concept of a laser beam illuminating product in order to examine the light that is transmitted through or reflecting from the product is known. Cracks in the grain and other features can be detected using this method. The laser beam is typically focused to the smallest spot size possible. However, the object must be positioned precisely in order for the laser beam to illuminate the object. If the object is more than half of it's height (+/− ½ h) off the optical axis 67 along the z-axis, then the laser beam will not illuminate the object. Therefore, the presentation tolerance in the z-axis is limited by the object's height. This limitation is solved by replacing the laser beam 64 with a laser line 81. The laser line is generated using cylindrical lenses 84. The use of a laser line also permits a single laser to illuminate multiple individual pieces of product 51 at the same time. The width of the laser line should be smaller than the defect or crack in the product, for example, approximately five-thousandths of an inch for rice. The length of the line should completely cover product passing through the laser line 81 at a normal to the line and accommodate for any side-to-side movement by the product.

The method by which detection and separation system 15 operates for grain is illustrated by FIG. 8. The laser 17 transmits light through grain 51 as previously explained. The photo detector 16 receives the defracted light which transmits through grain 51. The photo detector 16 is connected to processor 90 by connection 91. The photo detector 16 sends signals to processor 90 through connection 91 which depends upon the amount of light received by photo detector 16. Processor 90 records the brightness of the light transmitted through grain 51 as a function of time. Graph 81 illustrates what the processor 90 records when a grain 51 contains a crack in its middle. When the laser beam is not transmitted through a grain, the laser light is not defracted towards photo detector 16 and a low level of light is registered at point 86. As a grain passes through laser beam 64 or laser line 81, the transmitted light 65 is defracted towards photo detector 16 and a certain brightness level 82 is recorded. When the laser beam 64 or laser line 81 passes through a crack, the transmitted light 65 will be defracted at a different angle or scattered angles and the photo detector will not receive as much transmitted light as shown by point 83. As a crack passes by the laser beam 64 or laser line 81 and a whole portion of the grain is analyzed, the photo detector 16 registers a higher brightness level as shown by point 84. When the grain passes the laser beam 64 or laser line 81, the brightness registered by photo detector 16 will once again drop to a point 87. If a whole grain passes through detection and separation system 15, then photo detector 16 should see an approximately constant brightness and would not see a drop in brightness like point 83.

Figure 9:
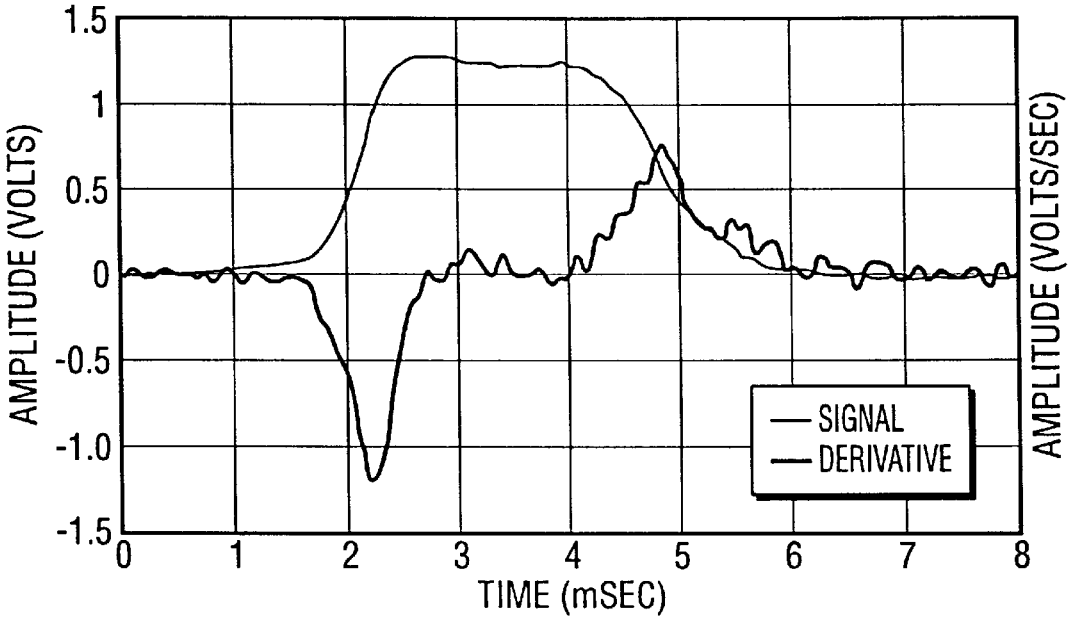
FIG. 9 shows the signal and derivative of a whole rice grain.
Figure 10:
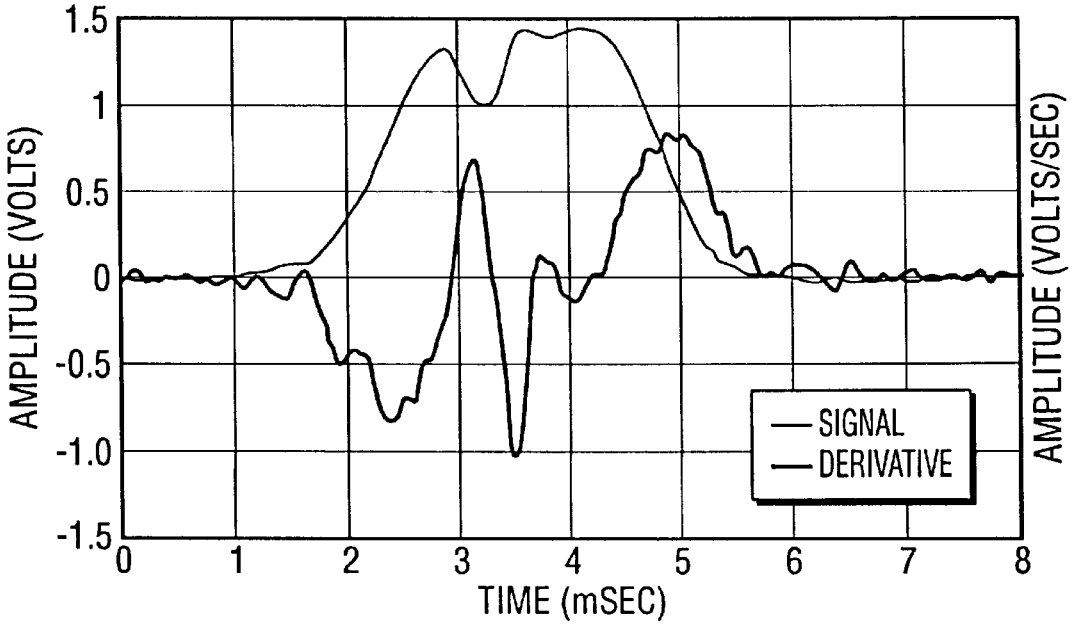
FIG. 10 shows the signal and derivative of a cracked rice grain.
Figure 11:
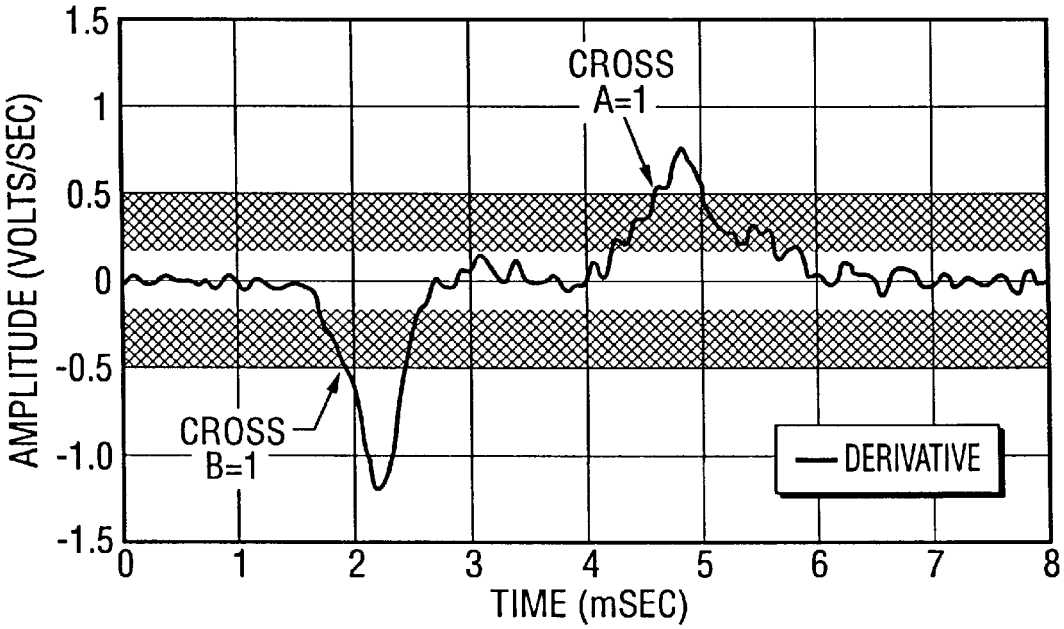
FIG. 11 shows the threshold crossing analysis of a whole rice grain.
Figure 12:
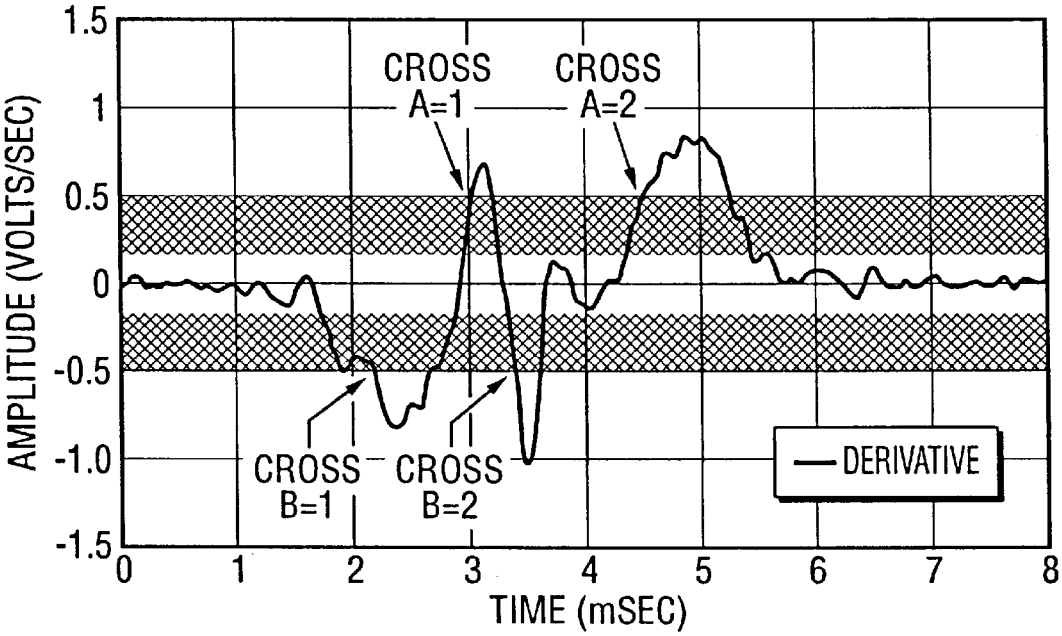
FIG. 12 shows the threshold crossing analysis of a cracked rice grain.
Figure 13:
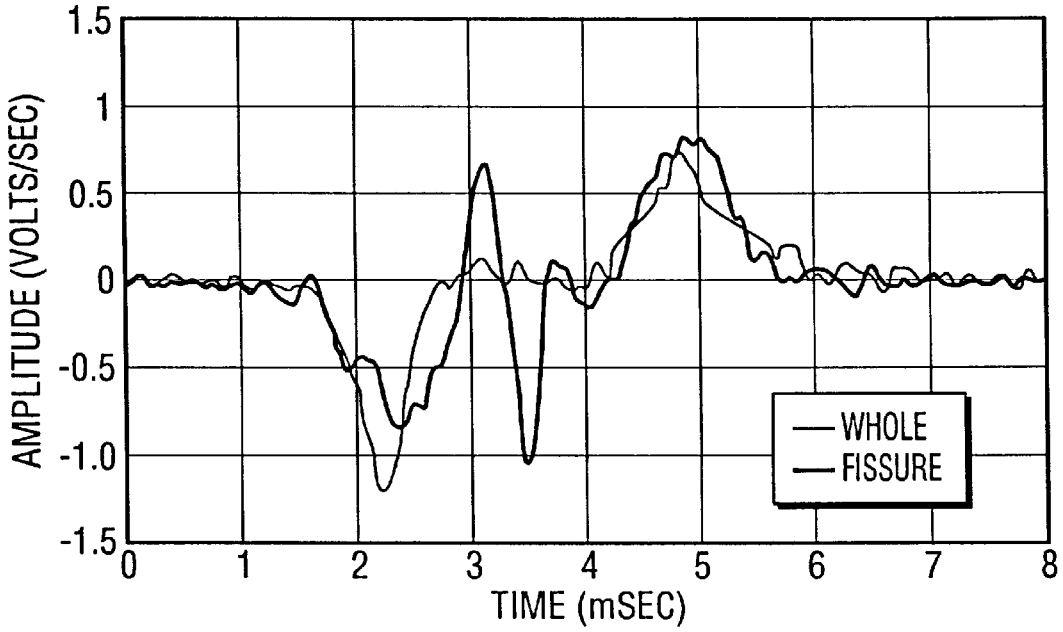
FIG. 13 shows a signal comparison between a whole and cracked grain.

Processor 90 determines from the brightness received by photo detector 16 if the grain 51 is internally cracked on internally whole. The processor 90 takes the derivative of the brightness as a function of time and compares the derivative to certain threshold points to categorize the grain 51. FIGS. 9 and 10 show the comparison between the signal and the derivative of a whole and cracked grain, respectively. FIGS. 11 and 12 show the threshold levels for the derivative of brightness for a whole and cracked grain, respectively. FIG. 13 shows a comparison of derivative signals between a whole and cracked grain. The threshold amounts will depend upon the intensity of the light transmitted through a grain.

When the processor 90 determines that an individual piece of product should be selected, for example, a grain that is internally cracked or imperfect, the processor 90 signals the nozzle 18 through connection 92 to release a blast of air 88 at the appropriate time to jettison the grain 51 or product from the path and onto rejected path 24. Note that the processor 90 could also signal nozzle 18 to blast whole grains or selected product onto path 24. Any other method known in the art for separating the selected product from the unselected product can be used. In addition, the product could be directed onto other conveyor belts or pathways that lead to further process steps.

Figure 14:
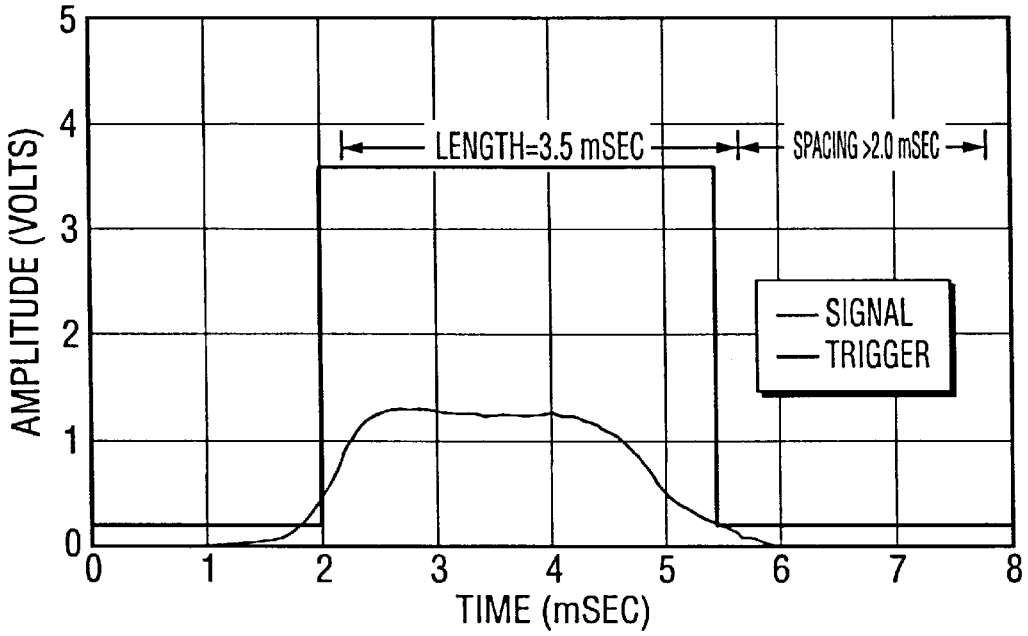
FIG. 14 shows a length and spacing analysis of a whole rice grain.

The present invention can also determine the length of product and the spacing between product. As shown in FIG. 14, the length of time which photo detector 16 registers a certain threshold level is indicative of the product length. The actual length is determined using the known velocity of the product passing through photo detector 16. The time between product passing through detection and separation system 16 indicates the spacing between product.

Generally, the present invention may be used to sort any type of product, including bulk agricultural products with individual pieces being less than approximately one-inch in size. The invention sorts selected product from unselected product. What is "selected" product and what is "unselected" product depends upon the user's needs. For example, the invention can be set up to select internally cracked or whole unhulled rice grains, shelled product or shells, small or large nuts, molded or non-molded beans or anything within the scope of the invention. The following provides some examples.

The present invention is useful to sort unhulled grains, especially to separate internally cracked unhulled grains from internally unhulled whole grains. After separating the cracked and uncracked grains, the internally cracked unhulled grains can be used for parboiling and the internally whole unhulled grains can be used for white rice milling. White rice millers would be willing to pay a premium for internally whole grains because it would result in lower production costs. At the same time, parboilers can utilize the internally cracked unhulled rice that the white rice millers would not want. Additionally, this process allows white rice millers to use certain varieties of rice that they normally would not use. Certain varieties of rice have high field yields, but high percentages of structural defects. The structural defects result in poor milling yield, giving high brokens in final white rice product. With the current invention, parboilers could use the structurally defective grains from high field yield rice and white rice millers can use the internally whole or structurally sound grains.

The invention can also be used on grains with their husks removed. Grains may have their husks removed and then stored for periods of time before processing. The grains can develop cracks during storage. These internally cracked grains can be removed before processing using the present invention.

The present invention can also be used on chalky rice. Rice can have uneven densities of starches within the grain. The varying densities are structural defects and are prone to breaking during milling. These structural defects can be analyzed and the grain rejected in much the same way the internal cracks are analyzed. The varying densities within the chalky grains defract and transmit light. From the amount of light transmitted through the grain to a photo detector, a processor can determine if the grain has such a structural defect.

Figure 15:
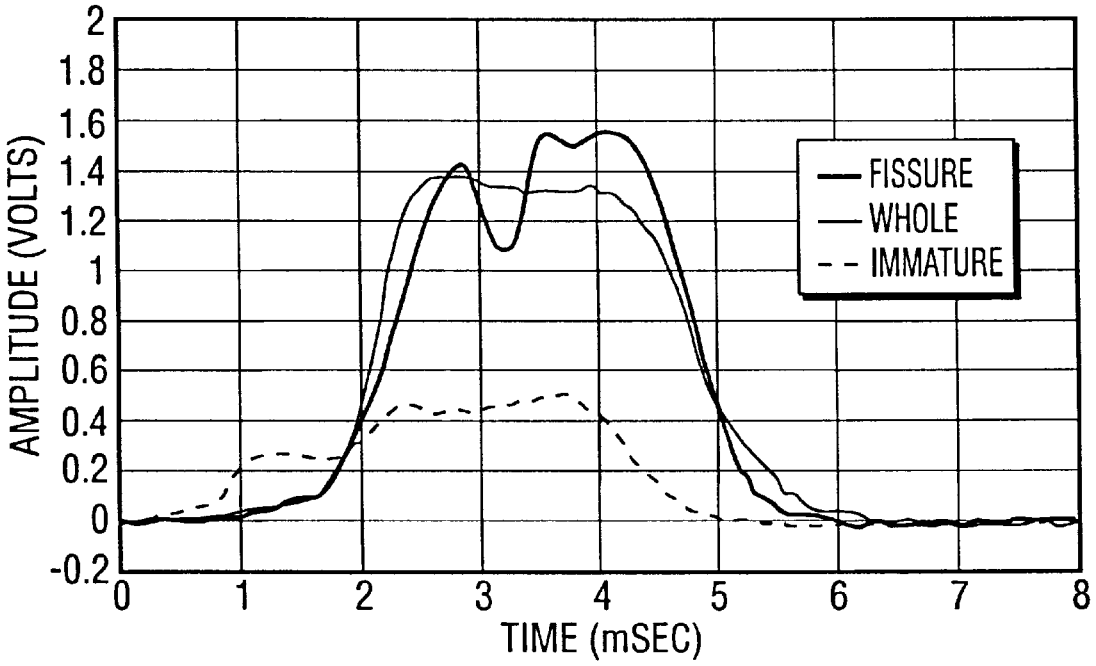
FIG. 15 shows a signal comparison between whole, cracked and immature rice grains.

The present invention can also be used to separate out other types of unselected hulled or unhulled grains. For example, immature grains will have a lower brightness than a mature grain as illustrated by FIG. 15. By setting up different thresholds, processor 90 could eject an immature grain with nozzle 18. Similarly shelled grain, peck, smut, red rice, stack burnt rice, and seeds could be removed using the same invention. Processor 90 would need to be reprogrammed for each unselected grain with different thresholds regarding brightness received by photo detector 16 and the amount of time certain thresholds are met.

The present invention can also be used to sort shelled blanched or unblanched nuts, including all ground and tree nuts such as hazelnuts, peanuts and almonds. In particular, blanched could be separated from unblanched nuts, split nuts from whole nuts, internally defective nuts from internally whole nuts, externally defective nuts from externally selected nuts, and sorting nuts from foreign material. When the present invention is used to sort nuts or any other product, the cross-section and profile design of chute 7 may need to be altered within the scope of the invention from the design detailed above for a grain. Specifically, cross-section of the chute should allow the nut or other product to position itself in a natural and consistent orientation. Furthermore, the amount of curvature and length needed for the profile of the chute should be designed to allow the specific nut or other product being sorted to create proper spacing between nuts or product. Most nuts, especially thicker and less translucent nuts, would require defects to be detected with reflected light rather than transmitted light.

With the use of this invention, ground nut and tree nut processors would realize an economic advantage in that they would be able to buy a lesser grade of nuts from suppliers. This raw material would not been pre-processed to the degree currently employed. This will have the effect of reducing that direct cost as well as open other sources of supply that would have been previously unacceptable.

The following provides an example of the benefit of this invention with respect to grain. FIG. 16 shows the results of a test run on rough rice using the method of this invention. All brokens values are on a weight percent milled basis. All weight fractions are based on the feed as a normalized value of 1.00. Row A of FIG. 16 shows the measured broken grain value for the as-is sample after white milling (no parboiling). Row B simply converts the weight percent of Row A to a weight fraction. Row C shows the typical percentage of rough rice kernels ejected during sorting in which the sorter is set to eject whole non-defective grains. Row D shows the measured broken grain value for the ejected non-defective kernels after white rice milling. Note that the level of brokens after white milling is significantly decreased from an incoming feed value of 23.8% to 4.1% for the ejected fraction. By this reduction alone it is very surprising in that very low brokens formation during white rice milled can be achieved comparable to brokens levels achieved during conventional paddy parboiling. Row E converts the brokens level after white milling in the ejected kernels portion to a weight fraction of the incoming rice. The importance of this value will be evident later in this example. Row F shows the percentage of incoming rough rice kernels not ejected which are analyzed as defective and structurally weak, thereby easily broken if not parboiled. If this portion was to be white milled without parboiling, a very high brokens value would result. Row G shows the weight percent brokens in the non-ejected portion after having been paddy parboiled and milled. Row H converts the brokens level after parboiling and milling to weight fractions of the incoming rice. Row I adds-together the weight fractions of brokens in both the ejected and non-ejected streams (Row E and H). Row J calculates the percentage avoidance of brokens where total white milling is the basis and the method of this invention is the improvement. 78% of brokens can be avoided in a milling scheme where 60% of the rice is white milled and 40% of the rice is paddy parboiled, on the ejected and non-ejected streams, respectively. Using the method of this invention it is therefore now possible to conduct white milling without suffering high brokens levels.

We claim:

1. An apparatus for sorting unselected product from selected product, comprising:

a chute defining a path for said product, said chute having a cross-section orientating said product, said chute having a separation section creating space between said product on said chute, said chute having a stabilizing section, said chute having an end;

an analyzing area for analyzing said product;

a light means having a laser line, said laser line being transmitted through or reflected from said product passing through said analyzing area;

a light detection means being positioned to receive said laser line transmitted through or reflected from said product;

an analyzing means for determining selected and unselected product, said analyzing means being coupled to said light detection means; and a separating means for sorting unselected product from selected product, said separating means being coupled to said analyzing means.

2. The apparatus of claim 1 wherein said laser line is generated by a cylindrical lens positioned in the path of a laser beam.

3. The apparatus of claim 1 wherein said light detection means comprises:

an outer shell defining a slit, said slit being positioned to receive said laser line transmitted through or reflected from said product into said outer shell;

at least one lens having a focal point, said lens being positioned inside said outer shell for receiving said laser line passing through or reflected from said product and for focusing said laser line at said focal point; and a photo detector being positioned inside said outer shell at said focal point.

4. The apparatus of claim 1 wherein said light detection means comprises:

an outer shell defining a front aperture and an interior slit, said front aperture being positioned to receive said laser line transmitted through or reflected from said product into said outer shell, said slit being positioned to receive said laser line transmitted through or reflected from said product and through said front aperture;

at least one lens having a focal point, said lens being positioned inside said outer shell between said front aperture and said slit for directing said laser line transmitted through or reflected from said product and said front aperture through said slit and for focusing said laser line at said focal point; and a photo detector being positioned inside said outer shell at said focal point.

5. The apparatus of claim 1 wherein said separating means comprises an air nozzle for blowing either unselected product or selected product out of said analyzing area.

6. The apparatus of claim 1 wherein said product is grain, nuts, or beans.

7. The apparatus of claim 1 wherein said separation section having a first angled section and a second angled section connected to said first angled section at an angle closer to vertical than said first angled section.

8. The apparatus of claim 1 wherein said stabilizing section having a curve, said curve exerting a centrifugal force on said product.

9. The apparatus of claim 1 wherein said product having a length and a belly, wherein said chute having an upper portion, a lower portion and a bottom, and wherein said upper portion of the chute further having a V or U shaped cross-section and said lower portion of the chute further having an H shaped cross-section, said V or U shaped cross-section orientating the length of said product parallel to said chute path, and said H shaped cross-section orientating said belly of said product on said bottom of said chute.

10. The apparatus of claim 1 wherein said chute further having a coating.

11. The apparatus of claim 1 wherein said analyzing section is located subsequent to said end of said chute.

12. An apparatus for sorting unselected product from selected product, comprising:

a chute for defining a path for said product, said chute having an end, a coating, a separation section and a stabilizing section, said separation section having a first angled section and a second angled section connected to said first angled section, wherein said second angled section is positioned at an angle closer to vertical than said first angled section, and wherein said stabilizing section of said chute having a curve, said curve exerting a centrifugal force on said product passing along said stabilizing section;

an analyzing area being positioned subsequent to said end of said chute;

a light means having a laser line, said laser line being transmitted through or reflected from said product passing through said analyzing section;

a light detection means having an outer shell, a lens, and a photo detector, wherein said an outer shell defining a slit, said slit being positioned to receive said laser line transmitted through or reflected from said product and into said outer shell, said lens having a focal point being positioned in said outer shell for receiving said laser line entering said outer shell and for focusing said laser line at said focal point, and a photo detector being positioned in said outer shell at said focal point;

an analyzing means for determining unselected product from selected product, said analyzing means being coupled to said light detection means;

a separating means for separating unselected product from selected product, said separating means having an air nozzle blowing either unselected product or selected product out of said analyzing area, said separating means being coupled to said analyzing means.

13. A method for sorting unselected product from selected product, comprising the steps of:

aligning said product in the longitudinal path of a chute;

creating distance between individual product in an inclined section of said chute;

stabilizing product in said chute with centripetal force for optical detection;

directing a laser through a cylindrical lens to create a laser line;

transmitting a laser through or reflecting a laser line from said product onto a photo detector;

receiving the transmitted or reflected laser line on the photo detector;

optically analyzing said product with a laser line and producing an output;

determining from said output of said optical analysis if said product are selected or unselected; and separating said unselected product from said selected product.

14. The method of claim 13 wherein said aligning step comprises orientating the length of said product parallel to said path of said chute and orientating the belly of said product on the bottom of said chute.

15. The method of claim 13, wherein said product is grain, nuts or beans.

* * * * *